US010529516B2

(12) United States Patent
Burger et al.

(10) Patent No.: US 10,529,516 B2
(45) Date of Patent: Jan. 7, 2020

(54) PYROTECHNIC SAFETY ELEMENT

(71) Applicant: LEONI BORDNETZ-SYSTEME GMBH, Kitzingen (DE)

(72) Inventors: Martin Burger, Buchbrunn (DE); Peter Steiner, Burghaslach (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 0 days.

(21) Appl. No.: 15/661,457

(22) Filed: Jul. 27, 2017

(65) Prior Publication Data

US 2017/0323747 A1 Nov. 9, 2017

Related U.S. Application Data

(63) Continuation of application No. PCT/EP2016/050495, filed on Jan. 13, 2016.

(30) Foreign Application Priority Data

Jan. 27, 2015 (DE) ..... 10 2015 201 371

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... H01H 39/006; H01H 2039/008
USPC ..... 337/416
See application file for complete search history.

(56) References Cited

U.S. PATENT DOCUMENTS 3,274,363 A 9/1966 McGirr et al.
4,056,884 A * 11/1977 Williamson ..... H01H 69/02 29/417
4,224,487 A * 9/1980 Simonsen ..... H01H 39/006 200/61.08
4,417,519 A * 11/1983 Lutz ..... H01H 39/004 102/263
4,488,137 A 12/1984 Rooney et al.
4,830,631 A * 5/1989 Hsueh ..... H01H 85/201 337/187
5,535,842 A * 7/1996 Richter ..... B60K 28/14 180/271

(Continued)

FOREIGN PATENT DOCUMENTS

DE 202004004393 U1 7/2004
DE 102011103834 A1 12/2012

(Continued)

OTHER PUBLICATIONS

English Machine Translation—JP/2000-156142, Inoue et al., Jun. 6, 2000.*

*Primary Examiner* — Anatoly Vortman
(74) *Attorney, Agent, or Firm* — Laurence A. Greenberg; Werner H. Stemer; Ralph E. Locher

(57) ABSTRACT

A pyrotechnic safety element is particularly suited for use in motor vehicles. The safety element includes a conductor, a pyrotechnic unit with a pyrotechnic propellant charge, a severing member for severing the conductor, and a housing. The conductor is composed of two separate conductor parts which are joined at a joining point and are severed by the severing member when the device is triggered.

19 Claims, 3 Drawing Sheets

(56) References Cited

U.S. PATENT DOCUMENTS

| | | | | |
|---|---|---|---|---|
| 5,880,666 | A * | 3/1999 | Matsuoka | H01H 85/201 337/186 |
| 6,519,159 | B1 * | 2/2003 | Weinmeier | H05K 7/1428 361/688 |
| 6,556,119 | B1 * | 4/2003 | Lell | H01H 37/323 180/279 |
| 7,123,124 | B2 * | 10/2006 | Caruso | H01H 39/006 337/157 |
| 7,205,879 | B2 * | 4/2007 | Kordel | H01H 39/006 337/157 |
| 7,222,561 | B2 * | 5/2007 | Brede | B23D 15/145 200/61.08 |
| 7,239,225 | B2 * | 7/2007 | Tirmizi | H01H 39/006 337/157 |
| 7,767,921 | B2 | 8/2010 | Schloms et al. | |
| 7,772,958 | B2 * | 8/2010 | Schlotzer | H01H 39/00 200/61.08 |
| 8,009,010 | B2 * | 8/2011 | Pentell | H01H 85/2015 337/186 |
| 8,446,241 | B2 | 5/2013 | Filiputti et al. | |
| 9,425,010 | B2 * | 8/2016 | Hentschel | H01H 39/006 |
| 9,704,681 | B2 * | 7/2017 | Fukuyama | H01H 39/006 |
| 9,953,783 | B2 * | 4/2018 | Fellmer | H01H 39/006 |
| 2004/0041682 | A1 * | 3/2004 | Pasha | H01H 39/006 337/401 |
| 2008/0204184 | A1 * | 8/2008 | Lietz | H01H 85/08 337/290 |
| 2012/0162944 | A1 * | 6/2012 | Brantsch | B21D 39/02 361/759 |
| 2015/0200065 | A1 | 7/2015 | Koetter et al. | |
| 2017/0263403 | A1 * | 9/2017 | Marlin | H01H 39/006 |

FOREIGN PATENT DOCUMENTS

| | | | | |
|---|---|---|---|---|
| DE | 102012221664 | A1 | 4/2014 | |
| EP | 1710871 | A1 | 10/2006 | |
| EP | 2187417 | A1 | 5/2010 | |
| FR | 2911719 | A1 | 7/2008 | |
| FR | 3005200 | A1 * | 10/2014 | H01H 39/006 |
| JP | 2000156142 | A | 6/2000 | |

* cited by examiner

PYROTECHNIC SAFETY ELEMENT

CROSS-REFERENCE TO RELATED APPLICATION

This application is a continuation, under 35 U.S.C. § 120, of copending international application No. PCT/EP2016/050495, filed Jan. 13, 2016, which designated the United States; this application also claims the priority, under 35 U.S.C. § 119, of German patent application No. DE 10 2015 201 371.5, filed Jan. 27, 2015; the prior applications are herewith incorporated by reference in their entirety.

BACKGROUND OF THE INVENTION

Field of the Invention

The invention relates to a pyrotechnic safety element, in particular for use in motor vehicles. The safety element comprises a conductor, a pyrotechnic unit with a pyrotechnic propellant charge, a severing member for severing the conductor and a housing.

For protecting current paths of an electrical system of a motor vehicle, integrated in the current paths there are typically so-called fusible links, which melt or blow when an overcurrent occurs, and thereby disconnect the corresponding current path or the corresponding current paths from the energy supply.

Also used in addition in motor vehicles are so-called pyrotechnic safety elements, which do not serve for avoiding overcurrents but are triggered by a firing signal, that is an active activation, when a predetermined condition, the so-called triggering condition, is satisfied. A pyrotechnic safety element, also known as a pyrotechnic safety switch, pyrotechnic switch or pyrotechnic disconnecting element, is consequently a kind of emergency-off switch of the stop category 0 (EN ISO 13850:2008, subclause 4.1.4, and EN 6024-1:2006, subclause 9.2.2), which in principle can be manually triggered and/or automatically activated, and thereby triggered, under the predetermined triggering condition.

A corresponding pyrotechnic safety element is in this case constructed on the basis of a principle that is known per se. The element comprises a pyrotechnic propellant charge, which is ignited by an electrical firing signal, for example a sensor signal of a connected sensor, and as a consequence accelerates a severing member, usually a wedge or a pin, so that the latter mechanically severs an electrical conductor.

In motor vehicles, corresponding pyrotechnic safety elements are usually used as a so-called battery disconnect switch, which in the event of a traffic accident disconnects, and consequently isolates, the battery or the rechargeable battery (accumulator) of the motor vehicle from the rest of the electrical system of the motor vehicle. This has the effect of preventing electrical cable connections or electronic components that are exposed and/or damaged as a result of an accident from presenting a risk, in particular to rescue personnel, for example by igniting escaping oil or gasoline.

SUMMARY OF THE INVENTION

Against this background, the invention is based on the object of providing an advantageously designed pyrotechnic safety element.

With the above and other objects in view there is provided, in accordance with the invention, a pyrotechnic safety element, in particular for motor vehicles. The novel safety element comprises:

a conductor formed of two separate conductor parts being sheet-metal strips arranged along a common axis, said two separate parts adjoining one another in a longitudinal direction and being connected to one another at a connecting point by a formed connection;

a pyrotechnic unit with a pyrotechnic propellant charge;

a severing member for severing said conductor, said severing member, upon a triggering of the pyrotechnic safety element, moving along the common axis in the longitudinal direction in order to disconnect the two conductor parts from one another at said connecting point; and a housing enclosing said pyrotechnic unit said connecting point and said severing member.

A corresponding pyrotechnic safety element is in this case designed in particular for use in motor vehicles and comprises a conductor, a pyrotechnic unit, a severing member and a housing. The conductor is formed, according to the invention, by two separate conductor parts (i.e., subpieces, sub-elements), which are connected to one another at a connecting point and in the event of triggering are disconnected at the connecting point by the severing member.

Therefore, instead of the previously common practice of positioning a pyrotechnic unit with a severing member on a solid, one-part and one-piece conductor and severing it by means of the severing member in the event of triggering, in the case of a pyrotechnic safety element presented here in the event of triggering a connection between two conductor parts that was previously established under predetermined conditions is severed or disconnected.

Here, the connection is designed in such a way that the forces to be applied for a disconnection are significantly less than the forces that are to be applied to sever a solid conductor. As a result of this, a simpler and more compact pyrotechnic unit can then be used in the pyrotechnic safety element, and accordingly a pyrotechnic safety element preferably has a pyrotechnic unit which in the event of triggering converts a reduced amount of energy.

Although the force to be applied for a disconnection can in principle also be reduced by introducing clearances in the material of a solid conductor in the course of a finishing process, for example by drilling or milling, such a finishing process is also comparatively laborious and cost-intensive in comparison with the solution presented here.

According to a preferred design variant, furthermore, each conductor part, or subpiece, is formed by a conductor strip or sheet-metal strip and is for example produced from copper, for example Cu-ETP (electrolytic tough pitch copper), a copper alloy, aluminum or an aluminum alloy.

The connection of the two conductor parts is preferably performed according to the specifically intended application, that is to say for example also depending on the material used for the conductor parts, the connection in any event being designed in such a way that the forces to be applied for the disconnection are predetermined as exactly and expediently as possible. Moreover, the connection is designed in such a way that it is ensured that, after a triggering of the pyrotechnic safety element, not only the connection between the two conductor parts is disconnected but also the two conductor subsections are spatially separated sufficiently far from one another that current does not flow via the two conductor parts either because of a contact or because of a sparkover.

In this case, the two conductor parts are preferably formed as sheet-metal strips, the ends of which lie on one another, so that they overlap and are in surface-area contact in the end region or overlapping region. In this way it is ensured that the transfer resistance between the two conductor parts is relatively low, as long as the connection between the two conductor parts is intact.

In order to keep the production of the pyrotechnic safety element as simple as possible, it is also advantageous to connect the two conductor parts to one another by a deforming or forming process. Therefore, a purely mechanical and/or form-fitting connection is preferably formed between the two conductor parts, preferably dispensing with a material-bonding connection, for example by adhesive bonding or welding.

In an advantageous development, the connection of the two conductor parts is performed by means of clinching, conductor parts that are expediently formed as sheet-metal strips being used for this. These are then advantageously arranged for the clinching process in such a way that one end of one conductor strip lies on one end of the other conductor strip, so that the corresponding ends overlap, and the connection of the two conductor strips by clinching is then performed precisely in this region in which the two ends overlap.

For this purpose, the two correspondingly arranged conductor parts are typically arranged between a so-called female die and a male die and the connection between the conductor parts is then established by the male die and the female die being moved toward one another. Here, the male die is for example designed in the form of a cylinder and the female die has a cylinder-shaped depression with dimensions that are increased in comparison with the male die, so that during the clinching the cylinder form of the male die can be at least partially driven into the cylinder-shaped depression of the female die, and there is still sufficient space for material of the two conductor parts between the cylinder form of the male die and the cylinder-shaped depression of the female die.

It is in this case also advantageous if the sheet-metal strips or conductor strips have a sheet thickness of between 0.4 mm and 1.2 mm and if the conductor cross section is greater than 10 $mm^2$.

Furthermore, it is favorable to predetermine within the structural design an engagement for the severing member by which the desired movement of the severing member in the event of triggering is assisted, including because the reliability of the pyrotechnic safety element is increased as a result. If the severing member therefore has for example the form of a wedge, it is advantageous to predetermine as the engagement a kind of notch or form of angle that is open toward the severing member, so that in the event of triggering the wedge-shaped severing member is driven into the notch or the form of an angle and is thereby forced into a specifically predetermined movement.

If the two conductor parts are thus formed as sheet-metal strips which lie on one another in the region of the connecting point, it is expedient to predetermine a movement for the severing member in the event of triggering in such a way that it is driven between the two conductor parts lying one on the other and the two conductor parts are thereby spatially separated from one another. It is of advantage for this if that end of the conductor part toward which the severing member moves in the event of triggering is bent away from the other conductor part, that is to say as it were is bent up, so that the severing member in the event of triggering is forced under the bent-away or bent-up end of the corresponding conductor part and is driven between the two conductor parts. If the severing member is in this case designed in the form of a wedge, in the event of triggering the connection between the two conductor parts is disconnected by the severing member lifting or prizing the one conductor part off the other conductor part.

In an advantageous development, two conductor parts designed in the form of strips are then aligned and arranged along a common axis, so that they therefore adjoin one another in a longitudinal direction. In the event of triggering, the severing member moves along this common axis in the longitudinal direction in order to disconnect the two conductor parts from one another. In this case, one end of the one conductor strip preferably lies on one end of the other conductor strip, so that the two ends in certain regions overlap and lie over their surface area on one another.

On one of the two conductor parts in the form of strips there is then also preferably positioned a severing member, in particular in the form of a wedge, which in the event of triggering moves for example in the manner of a slide along the corresponding conductor part in the direction of the connecting point, that is in the direction of the region in which the two ends of the two conductor parts lie on one another, or rather is driven in the corresponding direction. Here, on the same side of the one conductor part on which the severing member lies there also lies in the region of the connecting point the other conductor part, the end piece of which that is facing the wedge-shaped severing member is bent away from the other conductor part, so that this end piece forms together with the other conductor part an engagement in the form of an angle for the wedge-shaped severing member, into which the wedge-shaped severing member is driven in the event of triggering, whereby the severing member is forced between the two conductor parts and as a result reliably detaches them from one another and spatially separates them from one another.

For reliable guidance of the severing member, it is preferably slidably mounted with a guiding element on the one conductor part. The guiding element is in this case formed in particular as a guiding strip arranged for example laterally on the conductor part, or at least comprises such a guiding strip.

As an alternative to this, the two conductor parts are fastened to one another in such a way that they form the form of an angle, and accordingly are not arranged along a common axis. Furthermore, it is also expedient to adapt the direction of movement or path of the severing member in the event of triggering in relation to the alignments of the two conductor parts to the respective intended application and/or the respective installation space specification.

Since the severing member is subjected to relatively low loads in the event of triggering because of the design of a pyrotechnic safety element presented here, a severing member produced from plastic can also be used in the case of a pyrotechnic safety element presented here, and a severing member of plastic, for example of polyoxymethylene (POM), is preferably also used because it is conducive to simplest possible production and for reasons of cost.

The housing is also preferably produced from a plastic, polyamide (PA) or polybutylene terephthalate (PBT) being used here for example. Moreover, the housing is advantageously kept simple, in particular also to keep the final assembly simple, that is to say the putting together of the prefabricated individual parts to form the pyrotechnic safety element. The housing is in this case preferably made up of precisely two housing parts, to be specific a side wall and a housing base, in the case of which a housing shell and a housing cover are connected to one another by way of a hinge, in particular a film hinge.

That housing base that typically encloses most of the other components of the pyrotechnic safety element in the end state of assembly is also preferably closed, and in particular closed off in an airtight manner, in the course of the final assembly, for example by the housing shell and the housing cover being welded to one another, that is to say for example on the side opposite from the film hinge. This achieves the effect that the pressure generated in the event of triggering by means of the pyrotechnic propellant charge of the pyrotechnic safety element can be used substantially completely for accelerating the severing member, and cannot as it were escape unused from the housing.

For fixing the housing or for mechanically fastening the housing to the conductor parts connected to one another, preferably formed on at least one conductor part is a retaining element, which is for example designed as a clearance in the material at which the housing is locked by a form fit in the end state of assembly.

In particular in the case of conductor parts in the form of strips, it is in this respect of advantage to design the retaining element in such a way that in each sheet-metal strip, that is to say in each conductor part, there are two lateral notched indentations lying opposite one another, so that the connecting point of the two conductor parts is as it were framed by four clearances in the material or notched indentations.

Since, as already mentioned above, the final assembly is to be kept as simple as possible, and apart from the conductor parts typically also led through the housing to the outside is a signal line, by way of which a firing signal is transmitted to the pyrotechnic propellant charge of the pyrotechnic unit in the event of triggering, according to a further advantageous design of the pyrotechnic safety element the pyrotechnic unit is encapsulated in plastic, to be precise in particular in such a way that precisely this plastic encapsulation forms the side wall of the housing. That plastic encapsulation is in this case made in the form of a ring, for example, and in the end state of assembly is preferably connected to the housing base by a form fit or fastened to the housing base. In the simplest case, for this a groove is formed on the housing base, positioned on the inner side of the housing base when the housing base is closed and preferably designed as a peripheral groove.

Since, as a result of the design of the pyrotechnic safety element presented here, relatively low forces have to be applied by the pyrotechnic unit for separating the two conductor parts in the event of triggering, the pyrotechnic propellant charge of the pyrotechnic unit is preferably adapted to the reduced requirements and is accordingly formed smaller and weaker. In particular as a result of this, altogether a relatively compact pyrotechnic safety element can be realized and, also for this reason, a pyrotechnic safety element presented here is also used and installed in so-called fuse boxes.

Corresponding pyrotechnic safety elements are consequently not only intended to isolate the fitted batteries or rechargeable batteries and disconnect them from the rest of the electrical system in a motor vehicle in the event of triggering, that is a say in particular in the event of a traffic accident, but also intended to isolate individual assemblies or electrical system units within the rest of the electrical system in the event of triggering, which is of advantage in particular if for example intermediate energy stores are integrated in the electrical system, that is for example capacitors, the discharge of which could likewise start a fire as a consequence of an accident.

Other features which are considered as characteristic for the invention are set forth in the appended claims.

Although the invention is illustrated and described herein as embodied in a pyrotechnic safety element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts and elements that correspond to one another are respectively provided with the same designations throughout the figures.

DETAILED DESCRIPTION OF THE INVENTION

Figure 1:
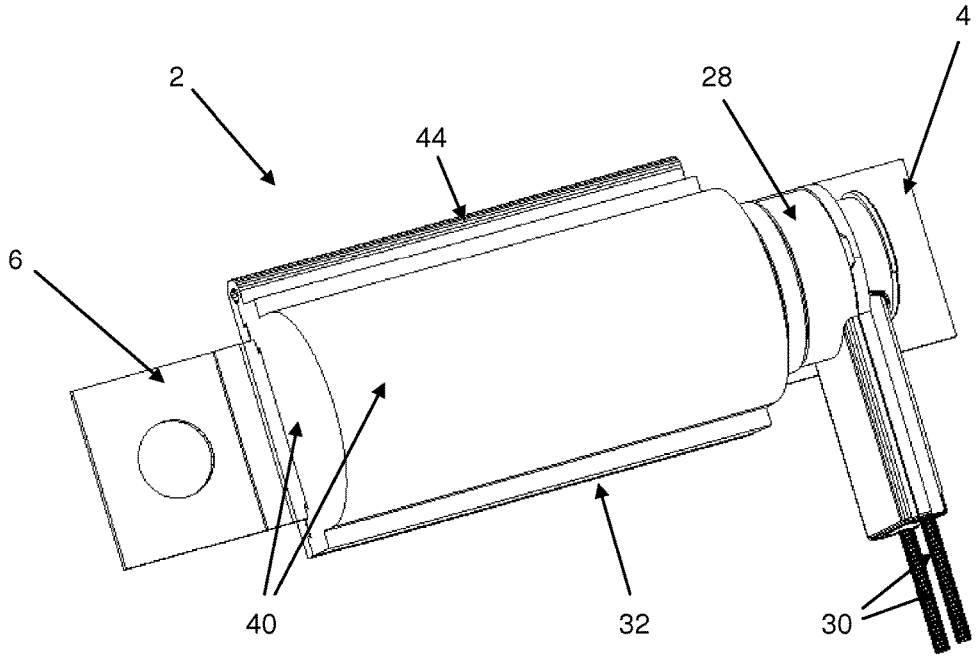
FIG. 1 is a perspective view of a pyrotechnic safety element with a conductor comprising two conductor parts connected to one another and with a housing.
Figure 2:
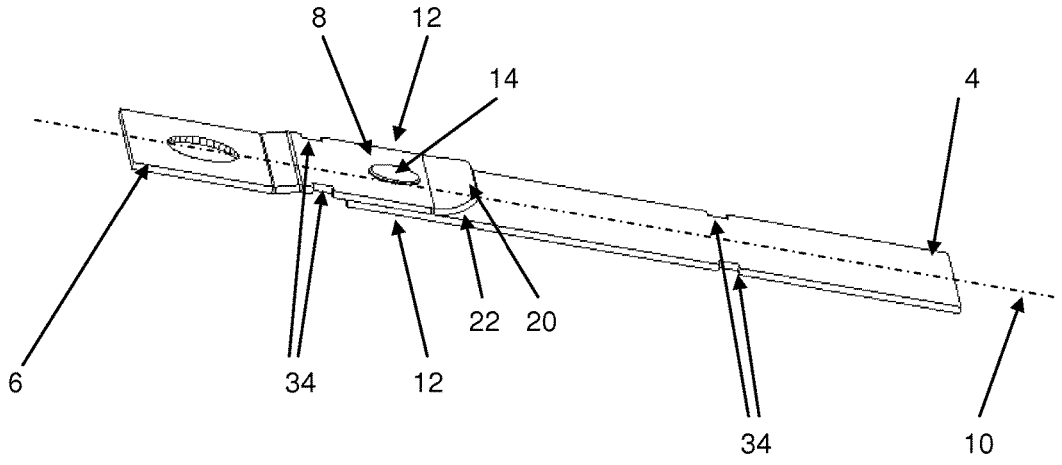
FIG. 2 is a perspective view of the two interconnected conductor parts.

Referring now to the figures of the drawing in detail and first, particularly, to FIGS. 1 and 2 thereof, there is shown an exemplary embodiment of a pyrotechnic safety element 2 in perspective. The safety element 2 has a first conductor part 4 and a second conductor part 6, which are connected to one another at a connecting point 8. The first conductor part 4 is in this case part of a power distribution plate or a bus bar (not included in full in the representation), which is fitted in a so-called fuse box of a motor vehicle. It forms here a connection arm of the distribution plate and consequently serves either as an input current path or as an output current path, which is connected by way of the distribution plate to further connection arms and consequently other current paths of the electrical system of the motor vehicle.

As shown in FIG. 2 reveals, the two conductor parts 4, 6 designed in the form of strips are arranged along a common connecting axis 10, to be precise in such a way that one end 12 of the second conductor part 6 lies on one end 12 of the first conductor part 4, so that the two ends 12 overlap and are in surface-area contact (i.e., areal contact) in the region of the connecting point 8. For the mechanical connection of the two conductor parts 4, 6 there is a clinching joint 14 formed approximately in the middle of the region of the area of contact, which is produced in the course of a clinching process by means of a cylinder-shaped male die and a female die.

Figure 3:
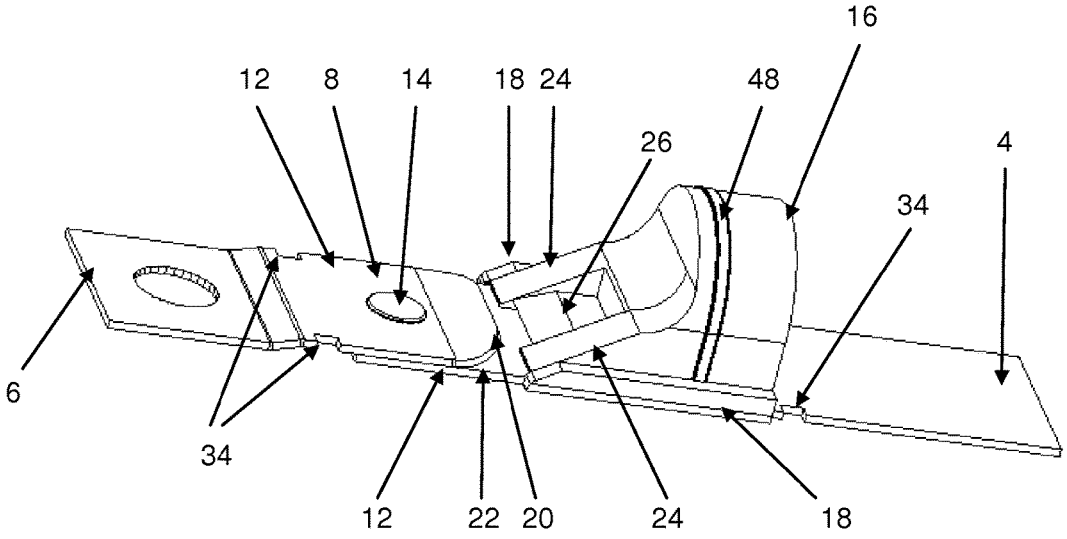
FIG. 3 is a second perspective view showing the two conductor parts connected to one another together with a severing member.
Figure 4:
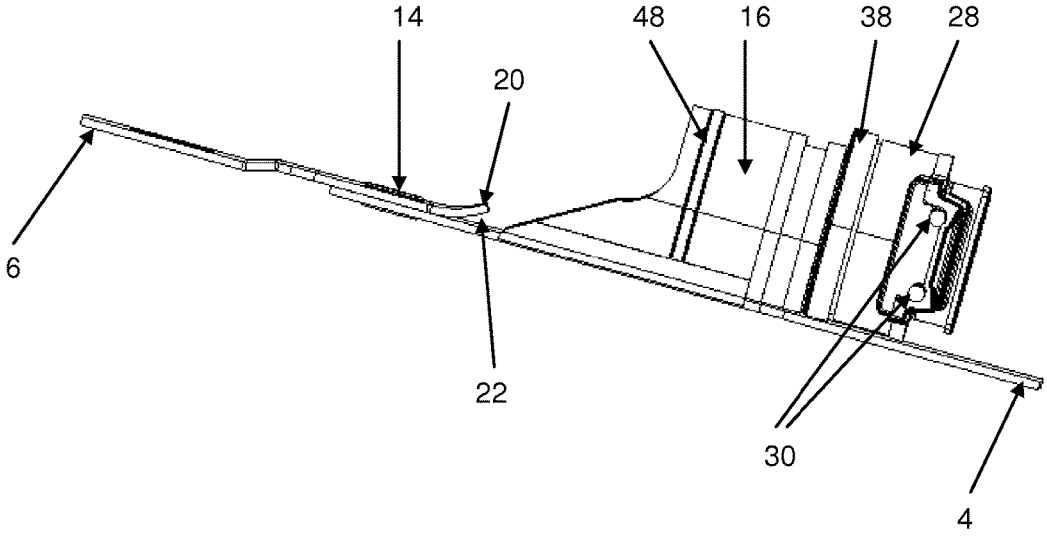
FIG. 4 is a third perspective view of the two conductor parts connected to one another together with a severing member and a pyrotechnic unit.

In the event of triggering, precisely this clinching joint is destroyed with the aid of a severing member 16 represented in FIG. 3, and consequently the mechanical connection between the two conductor parts 4, 6 is once more disconnected. In this case, the severing member 16 positioned on the first conductor part 4 is accelerated by a pyrotechnic propellant charge along the connecting axis 10 in the direction of the connecting point 8. As a result, the severing member 16 slides on the first conductor part 4 in the direction of the end 12 of the second conductor part 6, the severing member 16 being guided by two guiding strips 18, which are integrally formed on the severing member 16 and are positioned on both sides, that is in a flanking manner or straddling manner, on the first conductor part 4.

In the course of the movement of the severing member 16, the front of the severing member 16, which is in the form of a wedge, reaches the end 12 of the second conductor part 6, which has in the end region a kind of bent lug 20, which points away from the first conductor part 4 and together with the latter forms an angle-like engagement 22 for the wedge-shaped front of the severing member 16. This has the effect that the severing member 16 is reliably driven under the second conductor part 6, and consequently between the two conductor parts 4, 6. As a consequence, the severing member 16 as it were peels the end 12 of the second conductor part 16 off the first conductor part 4, and thereby disconnects the mechanical connection between the two conductor parts 4, 6.

In this case, the wedge-shaped front of the severing member 16 has a number of geometrical subforms, which differ from one another with regard to their function. For instance, arranged on the sides are two main wedges 24, which disconnect the connection between the two conductor parts 4, 6 and in the course of the movement of the severing member 16 are guided past the clinching joint 14, or rather past the position of the clinching joint 14. Positioned between the two main wedges 24 is a much flatter-formed auxiliary wedge 26, which is arranged downstream of the main wedges 24 (i.e., behind in the functional movement during the severing process) and serves primarily for separating the two conductor parts 4, 6 spatially from one another after the interruption of the connection, and keeping them separated, in particular in the region of the clinching joint 14.

As already mentioned, the acceleration of the separating member 16 in the event of triggering is caused by a pyrotechnic propellant charge, which is part of a pyrotechnic unit 28 and is ignited by means of a firing signal. In the exemplary embodiments, this firing signal is generated in an airbag control unit of the motor vehicle that is not shown and is fed into the pyrotechnic unit 28 by way of a signal line 30 and plug-in contacts on the pyrotechnic unit 28. Consequently defined as a triggering condition is a traffic accident that leads to the triggering of the airbag system of the motor vehicle controlled by the airbag control unit, and it is precisely in this case that the firing signal that ignites the pyrotechnic propellant charge in the pyrotechnic unit 28 is then also generated.

As FIG. 1 reveals, the pyrotechnic safety element 2 furthermore comprises a housing 32, which in the end state of assembly is fastened with the aid of four locking notches 34 to the conductor parts 4, 6 connected to one another and encloses the connecting point 8 together with the severing member 16 and the pyrotechnic propellant charge.

Figure 5:
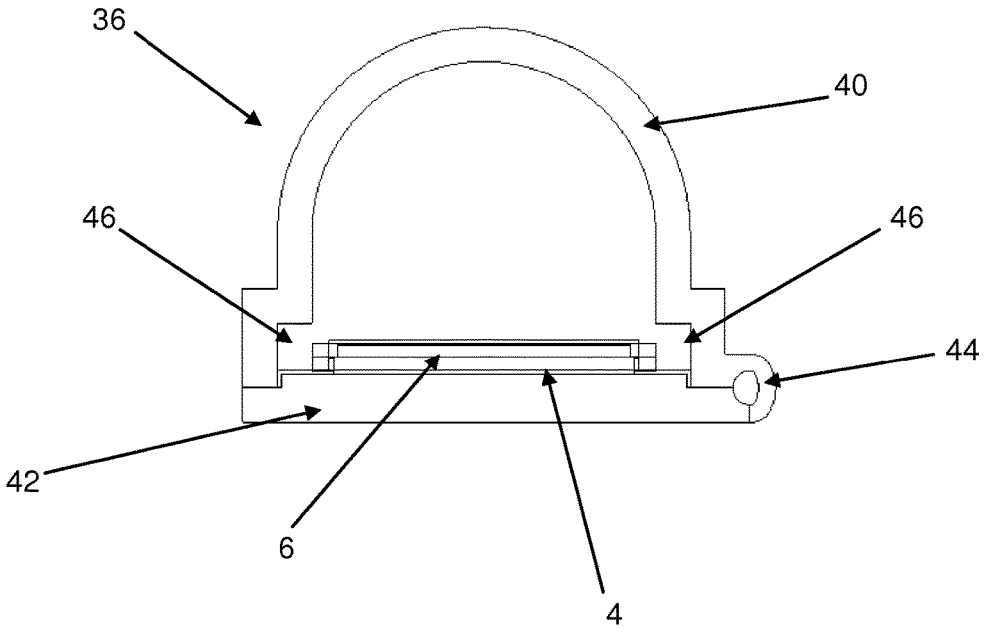
FIG. 5 is a section taken through the housing together with the two conductor parts connected to another.

The housing 32 is in this case designed as two parts and consists of a housing base 36, which is depicted in FIG. 5, and also a side wall 38, which is formed by a plastic encapsulation on the pyrotechnic unit 28. In the end state of assembly, that housing wall 38 lies as it were as a sealing ring in a groove on the inner side of the housing base 36, so that as a result the side wall 38 is connected to the housing base 36 in a form-fitting manner.

The housing base 36 in turn has a housing shell 40 and a housing cover 42, which as subforms of the housing base 36 are connected to one another by way of a film hinge 44. In the course of the final assembly, the housing shell 40 is then slipped or fitted over the conductor parts connected to one another together with the severing member and the pyrotechnic unit 28, at least up to the side wall 38, and subsequently the housing cover 42 is closed and welded on the side opposite from the film hinge 44.

FIG. 5 shows that the housing 32 forms together with the conductor parts 4, 6 lateral receptacles 46 for the guiding strips 18 of the severing member 16, which in the event of triggering bring about a very precise guidance of the severing member 16 in the manner of a rail guide.

By contrast, the sealing ring 48 that can be seen in FIG. 3 is not intended to contribute to the guidance of the severing member 16, but primarily to use the increase in pressure generated in the event of triggering by the pyrotechnic propellant charge in the region behind the severing member 16 as completely as possible for the acceleration of the severing member 16, and as far as possible not to allow it to escape unused by way of any openings or gaps.

Figure 6:
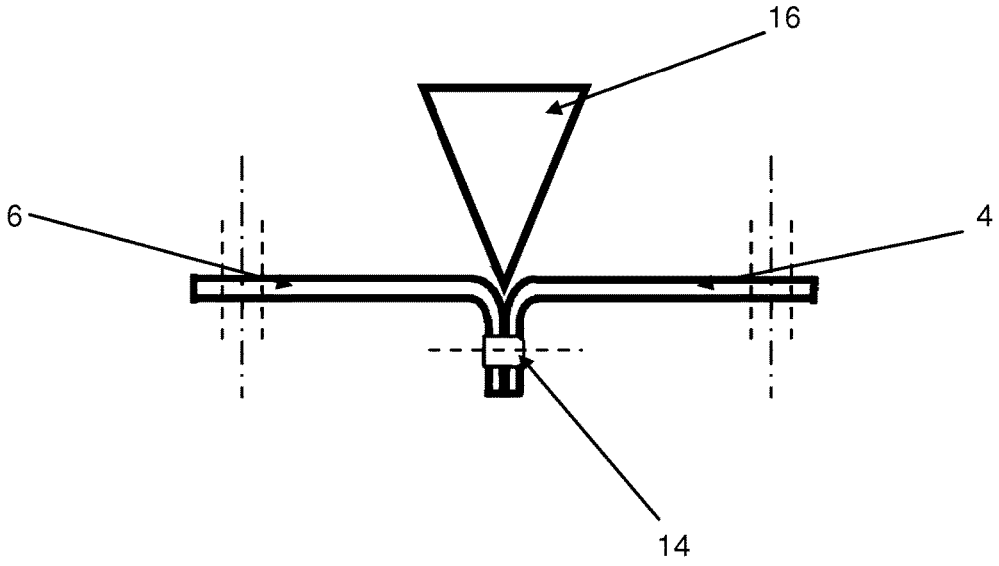
FIG. 6 is a side view showing two conductor parts connected to one another with an alternative design of the connection.

FIG. 6 illustrates an alternative design of the connection between the two conductor parts 4, 6 in a schematic view. Here, the conductor parts 4, 6 are bent or angled away in the end region and the severing member 16 is driven perpendicularly in relation to the connecting axis between the two end regions of the two conductor parts 4, 6.

The invention is not restricted to the exemplary embodiment described above. Rather, other variants of the invention can also be deduced by a person skilled in the art without departing from the subject matter of the invention. In particular, furthermore, all of the individual features described in connection with the exemplary embodiment can also be combined with one another in some other way without departing from the subject matter of the invention.

The following is a summary list of reference numerals and the corresponding structure used in the above description of the invention:

2 pyrotechnic safety element
4 first conductor part
6 second conductor part
8 connecting point
10 connecting axis
12 end
14 clinching joint
16 severing member
18 guiding strip
20 lug
22 engagement
24 main wedge
26 auxiliary wedge
28 pyrotechnic unit
30 signal line
32 housing
34 locking notch
36 housing base
38 side wall
40 housing shell
42 housing cover
44 film hinge
46 receptacle
48 sealing ring

The invention claimed is:

1. A pyrotechnic safety element, comprising:

a conductor formed of two separate conductor parts being sheet-metal strips arranged in a line on a common axis over an entire length thereof, the two separate parts adjoining one another in a longitudinal direction and being connected to one another at a connecting point by a mechanically shaped joint, the conductor parts extending in opposite directions away from the connecting point along a direction of the common axis;

a pyrotechnic unit with a pyrotechnic propellant charge;

a severing member for severing the conductor, the severing member, upon a triggering of the pyrotechnic safety element, moving along the common axis in the longitudinal direction in order to disconnect the two conductor parts from one another at the connecting point; and a housing enclosing the pyrotechnic unit the connecting point and the severing member.

2. The safety element according to claim 1, wherein one end of one the sheet-metal strip lies on one end of the other the sheet-metal strip, forming an overlap between the ends.

3. The safety element according to claim 2, wherein the two sheet-metal strips are connected to one another with at least one end of one sheet-metal strip protruding beyond the connecting point, to thereby form a projection on which the severing member engages in the event of triggering.

4. The safety element according to claim 3, wherein the projection is bent up, enabling the severing member to engage under the projection in the event of triggering.

5. The safety element according to claim 1, wherein the two conductor parts are fastened to one another to form an angle therebetween.

6. The safety element according to claim 1, wherein the severing member has a shape of a wedge and, in the event of triggering, the severing member disconnects the connection between the two conductor parts in that the severing member lifts one the conductor part off the other the conductor part.

7. The safety element according to claim 1, wherein the severing member is a plastic material element.

8. The safety element according to claim 1, wherein the housing is formed of precisely two housing parts.

9. The safety element according to claim 8, wherein the two housing parts are a side wall and a housing base, the two housing parts defining a housing shell, a housing cover, and a film hinge connecting the housing shell and the housing cover to one another.

10. The safety element according to claim 7, wherein at least one of the conductor parts is formed with a void in a material thereof for fastening the housing to the at least one conductor part.

11. The safety element according to claim 9, wherein the pyrotechnic unit is led through the side wall and the pyrotechnic unit is encapsulated in plastic for forming the side wall.

12. The safety element according to claim 1 configured as a safety element for a motor vehicle.

13. A fuse box for a motor vehicle, comprising a pyrotechnic safety element according to claim 1.

14. The safety element according to claim 1, wherein the two conductor parts are connected to one another by a clinching joint.

15. The safety element according to claim 1, wherein the severing member has a wedge-shape with a plurality of geometrical sub-forms that differ from one another with respect to function.

16. A pyrotechnic safety element, comprising:

a conductor formed of two separate conductor parts being sheet-metal strips arranged in a line on a common axis the two separate parts adjoining one another in a longitudinal direction and being connected to one another at a connecting point by a mechanically shaped joint, the conductor parts extending opposite one another away from the connecting point in a direction of the common axis;

a pyrotechnic unit with a pyrotechnic propellant charge;

a severing member for severing the conductor, the severing member, upon a triggering of the pyrotechnic safety element, moving along the common axis in the longitudinal direction in order to disconnect the two conductor parts from one another at the connecting point, the severing member having two guiding strips disposed opposite one another and straddling the conductor for guiding the severing member on the conductor; and a housing enclosing the pyrotechnic unit the connecting point and the severing member.

17. The safety element according to claim 16, wherein the housing with the conductor defines lateral receptacles to receive the guiding strips and guide the severing member.

18. A pyrotechnic safety element, comprising:

a conductor formed of two separate conductor parts being sheet-metal strips arranged in a line on a common axis the two separate parts adjoining one another in a longitudinal direction and being connected to one another at a connecting point by a mechanically shaped joint, the conductor parts extending opposite one another away from the connecting point in a direction of the common axis;

a pyrotechnic unit with a pyrotechnic propellant charge;

a severing member for severing the conductor, the severing member, upon a triggering of the pyrotechnic safety element, moving along the common axis in the longitudinal direction in order to disconnect the two conductor parts from one another at the connecting point, the severing member having a wedge-shape with a plurality of geometrical sub-forms differing from one another with respect to function, the sub-forms including two lateral main wedges with an auxiliary wedge disposed therebetween, the auxiliary wedge being flatter in slope than the main wedges; and a housing enclosing the pyrotechnic unit the connecting point and the severing member.

19. A pyrotechnic safety element, comprising:

a conductor formed of two separate conductor parts being sheet-metal strips arranged in a line along a common axis over an entire length thereof, the two separate parts adjoining one another in a longitudinal direction and being connected to one another at a connecting point by a formed connection being a clinching connection, the conductor parts extending in opposite directions away from the connection along a direction of the common axis;

a pyrotechnic unit with a pyrotechnic propellant charge;

a severing member for severing the conductor, the severing member, upon a triggering of the pyrotechnic safety element, moving along the common axis in the longitudinal direction in order to disconnect the two conductor parts from one another at the connecting point; and a housing enclosing the pyrotechnic unit the connecting point and the severing member.

* * * * *